United States Patent [19]

Lee

[11] Patent Number: 4,765,476

[45] Date of Patent: Aug. 23, 1988

[54] FLEXIBLE INSULATED CONTAINER

[76] Inventor: Richard E. Lee, 3829 Lakeshore Dr., Shreveport, La. 71109

[21] Appl. No.: 39,930

[22] Filed: Apr. 20, 1987

[51] Int. Cl.[4] ..... B65D 65/00

[52] U.S. Cl. ..... 206/427; 206/433; 206/523; 206/541; 206/545

[58] Field of Search ..... 206/545, 427, 433, 523, 206/541, 549

[56] References Cited

U.S. PATENT DOCUMENTS

| | | | |
|---|---|---|---|
| 2,680,556 | 6/1954 | Currie | 206/427 |
| 2,901,159 | 8/1959 | Talbot, Jr. | 206/427 |
| 4,096,985 | 6/1978 | Wood | 206/427 |
| 4,184,595 | 1/1980 | Wackerman | 206/427 |
| 4,314,638 | 2/1982 | Gordon et al. | 206/427 |
| 4,314,639 | 2/1982 | Gloyer | 206/427 |
| 4,378,877 | 4/1983 | Botterman et al. | 206/427 |
| 4,601,390 | 7/1986 | Rosenthal et al. | 206/427 |

FOREIGN PATENT DOCUMENTS

WO80/00951 5/1980 PCT Int'l Appl. ..... 206/427

*Primary Examiner*—Joseph Man-Fu Moy

*Attorney, Agent, or Firm*—John M. Harrison

[57] ABSTRACT

A flexible insulated container for thermally insulating beverages in glass containers or cans, as well as other food items, which includes an insulating bottom, insulating end panels and side panels attached to the bottom, which side panels extend above the top edges of the end panels and are provided with hand or finger openings for carrying purposes. In a preferred embodiment, an insulating seal flap attached to one of the side panels selectively closes the top of the insulated container beneath the extending ends of the side panels and loop-pile fasteners are used to maintain the seal flap over the top of the insulated container and to lap the extending ends of the side panels over the seal flap and each other, to further insulate the contents of the insulated container. When empty and not in use, the flexible insulated container can be collapsed for storage in a small space.

3 Claims, 1 Drawing Sheet

FLEXIBLE INSULATED CONTAINER

BACKGROUND OF THE INVENTION

1. Field of the Invention

This invention relates to insulated containers and coolers and more particularly, to a flexible insulated container which is constructed of a resilient, flexible sheet foam material that is capable of containing beverage bottles and cans, as well as food, in either a warm or cold condition. When empty, the insulated container is capable of being folded flat and easily stored in a small space, and when used, it operates to thermally insulate the contents. The flexible insulated container is characterized in a first preferred embodiment by a bottom, a pair of end panels and side panels which are glued or otherwise secured to the bottom and to each other, to form a box-like structure, with the upper portions of the side panels fitted with hand or finger openings and loop-pile fasteners for joining the extending edges of the side panels to define a handle. In a most preferred embodiment, a seal flap is provided between the side panels and is attached along one edge thereof to one of the side panels, for closing the top of the insulated container and more efficiently thermally insulating the contents. When the insulated container is not disposed in carrying configuration, but the contents are still to be thermally insulated, the extending portions of the side panels can be lapped upon each other on top of the seal flap and secured in this position by additional loop-pile fasteners to insulate the contents, with a high thermal insulating efficiency.

2. Description of the Prior Art

It is well known that beverage containers such as cans, bottles and the like are usually marketed in quantities of six by such expedients as plastic harnesses, paper cartons and like containers for securing the bottles or cans together. The grouping of six beverage containers is normally maintained with the selected packaging to facilitate shipping, storage, purchase and usage. These beverage containers are particularly popular for use in such outings as picnics, hiking, boating, sporting events and other outdoor activities. Under circumstances where it is desirable to keep such beverages cool or cold, an ice chest, cooler or other thermally insulating container must be utilized, wherein the beverage containers are normally placed in the ice chest or cooler and covered with ice. Furthermore, in cold weather, it is frequently necessary or desirable to keep food and beverages warm until they are consumed and a thermally insulating container is also useful for this purpose. One of the problems inherent in maintaining beverages or food in a cool or cold condition is that of supplying ice to the food or beverages on a periodic basis, in order to compensate for the ice which melts in the ice chest or cooler. Furthermore, large quantities of ice are heavy and under circumstances where many people are involved and a large quantity of beverage containers or food must be kept cool or cold during an outing, the cooling process is cumbersome and sometimes laborious.

U.S. Pat. No. 4,303,153, dated Dec. 1, 1981, to Gale E. Boulton, discloses an "Insulated Carrying Container for Beverage Containers". The thermally insulated carrying container detailed in this patent is designed to contain a plurality of beverage containers and is constructed entirely of a thin sheet of plastic foam material. The container includes side flaps which are normally located in an open position to facilitate access to the container interior and the side flaps can be moved to a closed position to facilitate cooling of the beverage container for a substantial period of time. A handle is provided to facilitate carrying of the container and a latching mechanism is provided to maintain the container in the closed configuration. U.S. Pat. No. 4,324,357, dated Apr. 13, 1982, to R. J. Murkowski, details a "Carton With Air Cushion End Structure". The carton disclosed in this patent is folded from a generally rectangular blank and includes at least one end structure characterized by inner and outer end walls which are disposed in spaced relationship, with an air cushion located between the end walls to cushion fragile articles packed in the container. A "Container" is disclosed in U.S. Pat. No. 3,487,913, dated Jan. 6, 1970, to B. Rohrbach. The Rohrbach container is characterized by a pair of side walls defining an interior chamber for receiving an object to be shipped. An access opening to the chamber is defined between the side walls and pins project outwardly from the lateral edges of the side walls perpendicular to the access opening, to hold and guide a flexible closure band which extends about the side walls and opening. U.S. Pat. No. 3,261,456, dated July 19, 1966, to G. C. Sparks, covers a "Mailable Package and Method of Manufacture". The package detailed in this patent includes a one-piece cover sheet which is cut and folded to define a back wall, end walls, inwardly-turned tabs and side walls. Top parts extend inwardly over the tabs and holding flaps engage the top parts. An insert body lies within the cover sheet and includes a compressible pad having an opening on one face and a skin provided on at least one pad face, with an opening conforming to the pad opening. The openings combine to define a recess, with the boundary edge of the skin opening releasibly retaining a yieldable article in the pad opening.

It is an object of this invention to provide a new and improved, flexible insulated container for thermally insulating beverages and food, which insulated container is characterized by a box-like structure constructed of a flexible foam material and provided with a bottom, end panels attached to the bottom and upward-standing side panels secured to the bottom and the end panels, with the extending upper portions of the side panels bendable inwardly at the top, where they are fitted with one or more openings to facilitate carrying the insulated container.

Another object of this invention is to provide a flexible, insulated container which is collapsible when empty and is constructed of a resilient, flexible foam material capable of thermally insulating the container contents, which insulated container is characterized by a bottom, a pair of end panels upward-standing from the bottom and a pair of side panels upward-standing from the bottom and connected to the end panels at the edges thereof, wherein a top segment of each of the side panels projects upwardly above the top edges of the end panels to facilitate inward folding and lapping of the side panels and closing the top of the insulated container to maintain the container contents in a thermally insulated configuration.

Still another object of the invention is to provide a flexible, collapsible, insulated container which includes a bottom, a pair of end panels upward-standing from the bottom in spaced, parallel, fixed relationship and a pair of side panels attached to the bottom and the end panels, with a portion of the side panels extending above the top edges of the end panels and hand openings provided in the extending portions of the side panels, for folding inwardly against each other and facilitating carrying the insulated container. In a preferred embodiment, a seal flap folds on the top edges of the end panels and closes the top of the insulated container and the extending portions of the side panels are foldable downwardly on each other and on the seal flap in lapped relationship, to further insulate the container contents.

Yet another object of the invention is to provide a new and improved, flexible and collapsible insulated container which is constructed of a flexible, expanded foam rubber material and is characterized by a box-like structure defined by a flexible bottom, flexible end panels extending from the bottom, flexible side panels extending from the bottom and secured to the end panels, with upper segments of the flexible end panels projecting above the top edges of the flexible end panels and designed to fold inwardly and provided with a handle opening for carrying the insulated container, and further including a seal flap closing the insulated container at the top edges of the end panels, wherein the upper segments of the side panels can be alternatively folded downwardly in lapped relationship over the seal flap to further insulate the insulated container when the insulated container is in non-carrying configuration.

SUMMARY OF THE INVENTION

These and other objects of the invention are provided in a new and improved, flexible and collapsible insulated container which is characterized by a box-like enclosure constructed of a resilient, flexible foam material, which box-like enclosure includes a flexible, insulating bottom member, a pair of flexible, insulating end panels upward-standing from the bottom member in fixed relationship and flexible, insulating side panels also extending from the bottom member in fixed relationship and connected at the edges thereof to the end panels, with upper segments of the side panels projecting above the top edges of the end panel in spaced, facing relationship. The upper segments of the side panels are provided with hand or finger openings, wherein in carrying mode, the upper segments of the side panels can be closed against each other for registration of the handle openings to provide a means for gripping the side panels and carrying the insulated container. In a preferred embodiment, a seal flap is attached to one of the side panels and closes against the other side panel along the top edges of the end panels, to further insulate the insulated container.

BRIEF DESCRIPTION OF THE DRAWING

The invention will be better understood by reference to the accompanying drawing, wherein.

DESCRIPTION OF THE PREFERRED EMBODIMENTS

Figure 4:
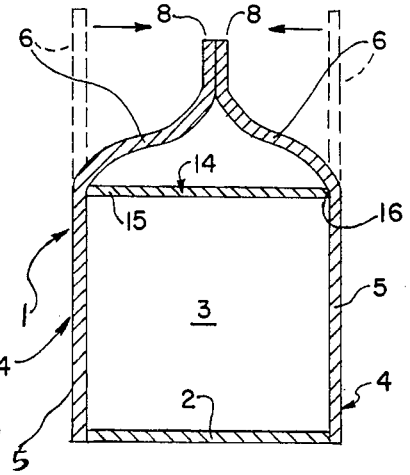
FIG. 4 is a sectional view taken along line 4—4 of the insulated container illustrated in FIG. 2, with the upper segments of the side panels pressed together in carrying configuration.
Figure 2:
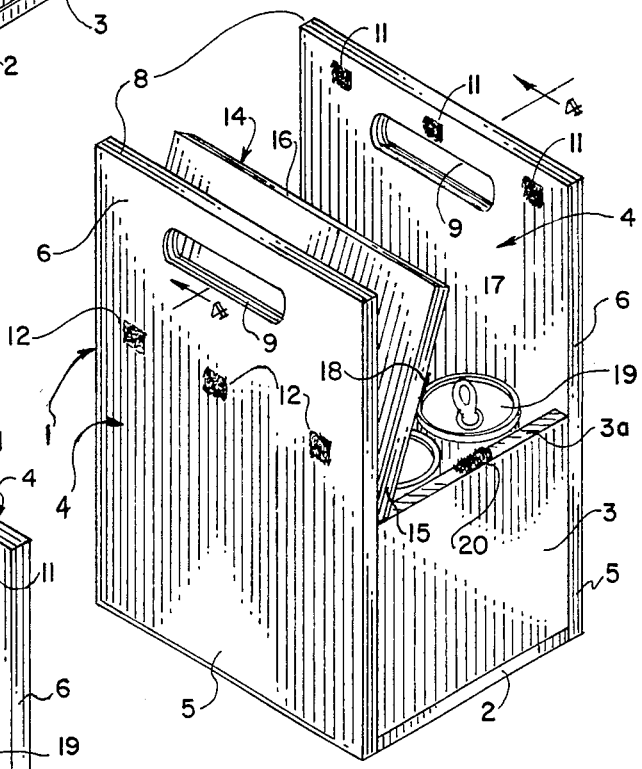
FIG. 2 is a perspective view of the insulated container illustrated in FIG. 1 in open configuration, with beverage cans located inside the insulated container.

Referring initially to FIGS. 2 and 4 of the drawing, the insulated container of this invention is generally illustrated by reference numeral 1. The insulated container 1 is characterized by a bottom 2, with a pair of oppositely-disposed end panels 3 extending upwardly from the bottom 2 and side panels 4 also extending upwardly from the bottom 2 and attached to the end panels 3 along the side edges thereof, as illustrated. The side panels 4 are both longer than the end panels 3 and are each further characterized by a lower segment 5, which is substantially co-extensive with the end panels 3 and an upper segment 6, which extends above the top edges 3*a* of the end panels 3 in parallel relationship, as illustrated in FIG. 2. In a preferred embodiment of the invention, a seal flap 14 is attached to one of the side panels 4 in hinged fashion at a seal flap base 15 and the opposite seal edge 16 of the seal flap 14 is designed to fit against the opposite side panel 4 when the seal flap 14 is closed over the beverage cans 19 located in the insulated container 1, as hereinafter further described. As further illustrated in FIGS. 2 and 4, the upper segments 6 of the side panels 4 are each terminated at an upper segment edge 8 and are further provided with hand openings 9, which can be aligned when the upper segments 6 are joined below the upper segment edges 8 to facilitate carrying the insulated container 1, as illustrated in FIG. 4. Accordingly, the insulated container 1 can be easily carried by grasping the upper segments 6 at the registering hand openings 9.

Referring again to FIG. 2, in a first preferred embodiment, the insulated container 1 is constructed of end panels 3 and side panels 4 which are glued or otherwise attached to the bottom 2 and to each other, to define the insulated container 1. Furthermore, the seal flap 14 can be glued or otherwise attached at the seal flap base 15 to one of the side panels 4, in order to facilitate opening and closing the seal flap 14 and provide access to the beverage cans 19. Furthermore, in another preferred embodiment, swatches of upper segment pile 11 are provided in spaced relationship along the inside surface of at least one of the upper segments 6 near the upper segment edge 8 and additional swatches of fold line loops 12 are provided in spaced relationship on the outside surface of the opposite side panel 4 beneath the corresponding hand opening 9, as illustrated. In a most preferred embodiment of the invention, the swatches of upper segment pile 11 and fold line loops 12 are provided on both inside surfaces of the upper segments 6 and the outside surfaces of the upper segments 6, respectively, to facilitate folding of the upper segments 6 over the seal flap 14 in any desired configuration, as hereinafter described. Additional swatches of side edge piles 18 are attached to the inside surface of the seal flap 14 near both side edges 17 and a cooperating end panel loop 20 is provided on each of the top edges 3*a* of the end panels 3, to receive and secure the side edge piles 18 when the seal flap 14 is closed over the beverage cans 19, with the seal edge 16 thereof lodged against the opposite one of the side panels 4, as hereinafter further described.

Figure 1:
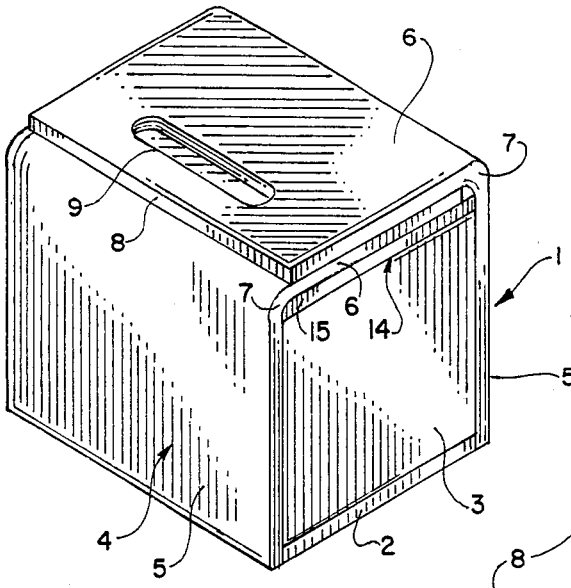
FIG. 1 is a perspective view of a preferred embodiment of the flexible insulated container in closed, maximum thermally insulating configuration.

Referring now to FIG. 1 of the drawings, when the insulated container 1 is disposed in non-carrying configuration and is deployed for maximum efficiency in thermally insulating the contents, the seal flap 14 is initially closed, as described above with respect to FIG. 2. The upper segment 6 of the side panel 4 which carries the fold line loop 12 is then folded along the fold line 7 against the seal flap 14 and the opposite upper segment 6 is folded across the first upper segment 6 along the opposite fold line 7, such that the spaced swatches of the upper segment pile 11 engage cooperating swatches of the fold line loops 12, to secure the respective upper segments 6 in folded configuration. It will be appreciated from a consideration of FIG. 1 that the triple thickness afforded by the lapped upper segments 6 and the seal flap 14 supplies an added insulating effect to the contents of the insulated container 1. This insulating advantage is particularly important under circumstances where the insulated container 1 is used in a boat, on a picnic or in outdoor areas where it is exposed directly to sunlight. The upper segments 6 of the side panels 4 are easily released and opened into the carrying configuration illustrated in FIG. 4, by grasping the upper segment edge 8 of the top upper segment 6 at the hand opening 9, releasing each upper segment pile 11 from the cooperating fold line loop 12 and opening the upper segments 6 to the configuration illustrated in FIG. 2.

Figure 3:
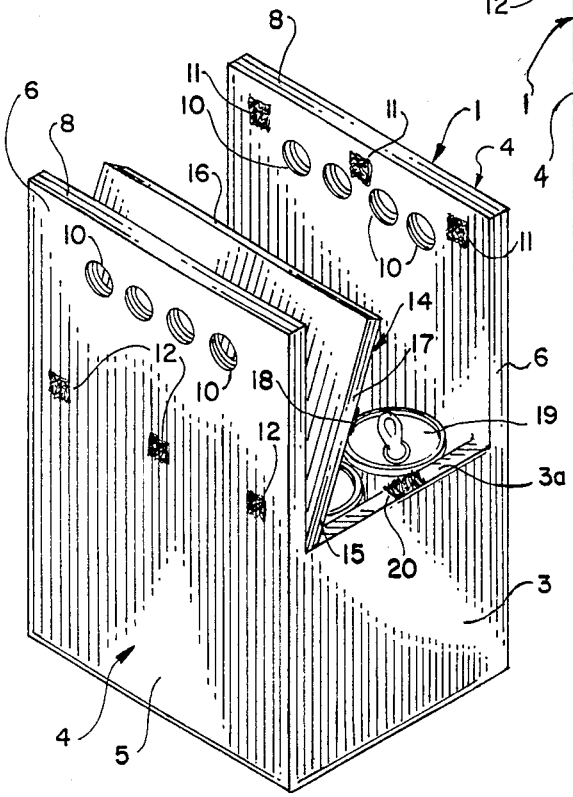
FIG. 3 is a perspective view of an alternative embodiment of the flexible insulated container illustrated in open configuration.

Referring now to FIG. 3 of the drawings, in a second preferred embodiment of the invention the upper segments 6 of the flexible insulated container 1 are each characterized by multiple finger openings 10, located below the upper segment edges 8, rather than the hand openings 9 illustrated in FIGS. 1 and 2. Furthermore, in this embodiment of the invention the insulated container 1 is constructed by injection molding or other molding techniques, wherein at least the bottom panel 2, end panels 3 and the side panels 4 are constructed in a single molding process. Furthermore, the seal flap 14 can either be molded in the primary molding process or attached, by gluing or otherwise, to one of the upper segments 6 of the side panels 4, as heretofore described, according to the knowledge of those skilled in the art. As in the case of the insulated container 1 illustrated in FIGS. 1, 2 and 4, the insulated container 1 illustrated in FIG. 3 includes swatches of the upper segment pile 11 which cooperate with companion swatches of fold line loop 12, in the same manner as illustrated in FIG. 1. Furthermore, the swatches of side edge pile 18 and cooperating swatches of end panel loop 20, are also used to close the seal flap 14 on the top edges 3*a* of the end panels 3 and over the beverage cans 19, as illustrated in FIG. 1. In this regard, and referring to FIGS. 2 and 3, it will be appreciated that both partial and lapped closure of the upper segments 6 can best be effected by applying a first set of upper segment pile 11 swatches to the inside surface of a first one of the upper segments 6 and a first set of fold line loop 12 swatches to the opposite, or second upper segment 6, as illustrated in FIG. 2. Additionally, a second set of the fold line loop 12 can be secured to the second upper segment 6 opposite the first set of upper segment pile 11. Furthermore, a second set of the upper segment pile 11 can be attached to the first upper segment 6 near the fold line 7 opposite the first set of fold line loop 12 swatches. In this manner, the first set of upper segment pile 11 can be secured to the second set of fold line loop 12 to orient the upper segment edges 8 together, as illustrated in FIG. 4. Furthermore, the first upper segment 6 can be folded over the seal flap 14 and the second upper segment 6 then folded over the first upper segment 6, such that the second set of fold line loop 12 engages the second set of upper segment pile 11, in a reverse folding arrangement to that which is illustrated in FIG. 1.

It will be appreciated by those skilled in the art that the flexible insulated container of this invention affords an efficient structure for thermally insulating beverages and foods of any description, without the necessity of applying ice or heat thereto. Furthermore, the flexible insulated container is capable of being folded or flattened when not in use to fit beneath the seat of a car, pick-up truck or other vehicle, or in a storage bag, for easy and efficient storage in a minimum of space. The flexible insulated container can be constructed of any resilient, flexible sheet foam material known to those skilled in the art, which is characterized by the desired insulating properties.

While the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. A thermally insulated flexible container constructed of a flexible foam sheet material, comprising:

(a) a flexible bottom and a pair of flexible end panels projecting from fixed attachment to said bottom in spaced, substantially parallel relationship;

(b) a pair of flexible side panels extending from fixed attachment to said bottom in spaced, substantially parallel relationship, with the edges of a lower segment of each of said side panels attached to said end panels along a portion of the length of said side panels, respectively, and an upper segment of each of said side panels extending beyond the top edges of said end panels, with said bottom, said end panels and said side panels forming an enclosure;

(c) at least one opening provided in said upper segment of each of said side panels, whereby said upper segment of each of said side panels is selectively joined at said opening, for carrying said flexible container in a first carrying mode and said upper segment of said side panels are each optionally folded against each other in lapped relationship, in a second non-carrying mode;

(d) a seal flap having one edge attached to one of said side panels and foldable on said top edges of said end panels and against the opposite one of said side panels, for closing said flexible insulated container;

(e) upper segment closure means secured to at least one of said side panels near said extending edges of said side panels and fold line closure means secured to at least the opposite one of said side panels near said fold lines, for folding said opposite one of said side panels over said seal flap and folding said at least one of said side panels over said opposite one of said side panels substantially along said fold lines and engaging said upper segment closure means and said fold line closure means to removably secure said side panels in folded configuration; and (f) flap closure means carried by said seal flap in spaced relationship near the edges of said seal flap and end panel closure means secured to said top edges of said end panels in alignment with said flap closure means, for engaging said flap closure means and removably securing said seal flap in closed configuration on said top edges of said end panels.

2. The thermally insulated flexible container of claim 1 wherein said at least one opening is a slot provided in each of said side panels for accommodating the hand of a user; said flap closure means is a loop element of a first loop-pile fastener and said end panel closure means is a pile element of said first loop-pile fastener; and said upper segment closure means is a loop element of a second loop-pile fastener and said fold line closure means is a pile element of said second loop pile fastener.

3. The thermally insulated flexible container of claim 1 wherein said at least one opening is four holes provided in spaced relationship in each of said side panels for accommodating the fingers of a user.

* * * * *